United States Patent [19]

Giffard

[11] 4,157,957

[45] Jun. 12, 1979

[54] SPLITTER ASSEMBLY HAVING AN ADJUSTABLE GAP WIDTH

[75] Inventor: Philip J. Giffard, Southport, Australia

[73] Assignee: Mineral Deposits Limited, Australia

[21] Appl. No.: 876,723

[22] Filed: Feb. 10, 1978

[30] Foreign Application Priority Data

Feb. 17, 1977 [AU] Australia ..... PC9099

[51] Int. Cl.[2] ..... B03B 11/00; B03B 5/62

[52] U.S. Cl. ..... 209/493; 209/458

[58] Field of Search ..... 209/493, 423, 427, 443, 209/458, 471, 477, 479, 466, 468, 424, 475, 422

[56] References Cited

U.S. PATENT DOCUMENTS

| | | | |
|---|---|---|---|
| 2,875,898 | 3/1959 | Spencer | 209/493 X |
| 4,078,997 | 3/1978 | Wright | 209/493 X |

FOREIGN PATENT DOCUMENTS

| | | | |
|---|---|---|---|
| 231070 | 1/1960 | Australia | 209/458 |
| 786442 | 9/1935 | France | 209/483 |

*Primary Examiner*—Ralph J. Hill

*Attorney, Agent, or Firm*—Stevens, Davis, Miller & Mosher

[57] ABSTRACT

A splitter assembly is described of the type wherein a pulp stream is discharged from the discharge edge of a stratification surface across a gap to impinge against a splitter so as to separate into upper and lower flow components, the lower component passing through the gap while the upper component flows over the splitter, characterized in that the splitter has a generally curved impingement surface and is adjustable relative to the stratification surface such that the gap width in the direction of stream flow increases as the required lower flow component increases and decreases as the required lower flow component decreases. Preferably, the splitter is hingedly mounted for rotation relative to the stratification surface.

8 Claims, 7 Drawing Figures

SPLITTER ASSEMBLY HAVING AN ADJUSTABLE GAP WIDTH

The present invention relates to the gravitational concentration of granular or particulate ores; this ore being treated in the form of a pulp (that is, a suspension of solid particles in water) wherein the required or value particles have a specific gravity higher than that of those of the remaining or unwanted particles.

It is known to achieve such a separation in a concentrator known as a tray concentrator in which the pulp is made to flow down the sloping floor of the tray under such conditions that the higher specific gravity particles tend to concentrate into the lower stratum of the pulp stream and this lower stratum, richer in higher specific gravity particles than the upper stratum, is then divided from the total stream by a splitting device.

The present invention is not directly concerned with the means for producing the stratified stream of pulp which may take any conventional form but rather is concerned with the means for splitting that stream into two component streams.

In early devices of this type, the splitter means usually comprised a sharp edged vane or wedge shaped body against an edge of which the stream impinged to cause the lower component stream to pass below the body and the upper component stream to pass above the body. However, it is known that such sharp edged splitter means have serious disabilities in that, if there are any variations in the depth or trajectory of the stream discharged onto the splitter, there are substantially variations in the relative proportions of the component streams since the edge of the splitter is fixed with relation to the stratification surface and not with relation to the resulting stream.

These disabilities have been greatly reduced in splitters subsequently developed with differing operating principles.

Australian Pat. No. 485,393 illustrates a splitter in which the stream is discharged from the surface on which stratification is achieved onto a generally curved surface with the relative proportions of the component streams then depending on the angle of incidence of the stream onto the splitter which is in turn dependent on which portion of the curved surface is exposed to the impact of the stream. Adjustment of the relative proportions of the component streams may therefore be achieved by translation of the curved surface across the stream.

It is an object of the present invention to provide an adjustment system for application to tray type separators in which the mode of translation further improves the performance of the complete splitter assembly.

It is characteristic of tray type splitters that the stream must be discharged from the stratification surface across a gap to impact on the splitter surface so that the lower component stream containing a concentration of high specific gravity particles is discharged downwards through the gap while the upper component stream is discharged over the splitter body. The width of the gap normally is not a controlling parameter of the splitter operation. However, if the gap is too narrow in the direction of flow to permit a free discharge of the lower component stream, the splitter no longer can achieve constant relative proportions of the component streams. Furthermore, if the gap is wider in the direction of stream flow than is required for the free discharge of the lower component stream, an unnecessary loss of efficiency can be introduced due to the increased magnitude of possible stream diversion from the mean path before impact as a result of variations in stream trajectory due to variations in the instantaneous velocity, percentage of solids and mass flow of the stream.

Therefore, it is desirable that the gap width should be adjusted so that it is small when the required lower component stream is small and should increase as the lower flow component increases. This should preferably be achieved with the minimum number of moving parts and joints in the system to maintain maximum mechanical accuracy and the areas of contact between components should not be so positioned as to be subject to contamination by the granular solids in the pulp stream.

According to one aspect of the invention there is provided a splitter assembly of the type wherein a pulp stream is discharged from the discharge edge of a stratification surface across a gap to impinge against a splitter so as to separate into upper and lower flow components, the lower component passing through said gap while the upper component flows over said splitter, characterised in that the splitter has a generally curved impingement surface and is adjustable relative to the stratification surface such that the gap width in the direction of stream flow increases as the required flow component increases and decreases as the required lower flow component decreases.

According to a further aspect of the invention there is provided a method of adjusting a splitter of the type wherein a pulp stream is discharged from the discharge edge of a stratification surface across a gap to impinge against the splitter so as to separate into upper and lower flow components, the lower component passing through said gap while the upper component flows over said splitter, including the step of increasing the gap width where the splitter is adjusted to produce an increased lower flow component or decreasing the gap width when the splitter is adjusted to produce a reduced lower flow component as the case may be.

Preferably, the splitter is hingedly mounted for rotation relative to the stratification surface. In this way, the object of the invention can be achieved by very simple means but it will be appreciated that other mounting arrangements will be possible.

A preferred embodiment of the present invention will now be described, by way of example only, with reference to the accompanying drawings in which.

Figure 1:
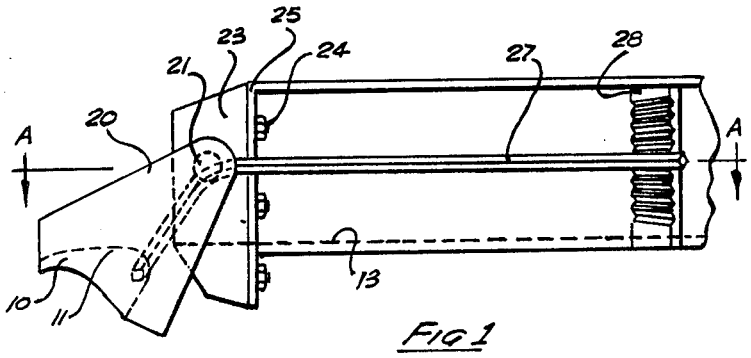
FIG. 1 is a side elevation of a splitter assembly embodying the invention, and forming part of a tray concentrator.
Figure 2:
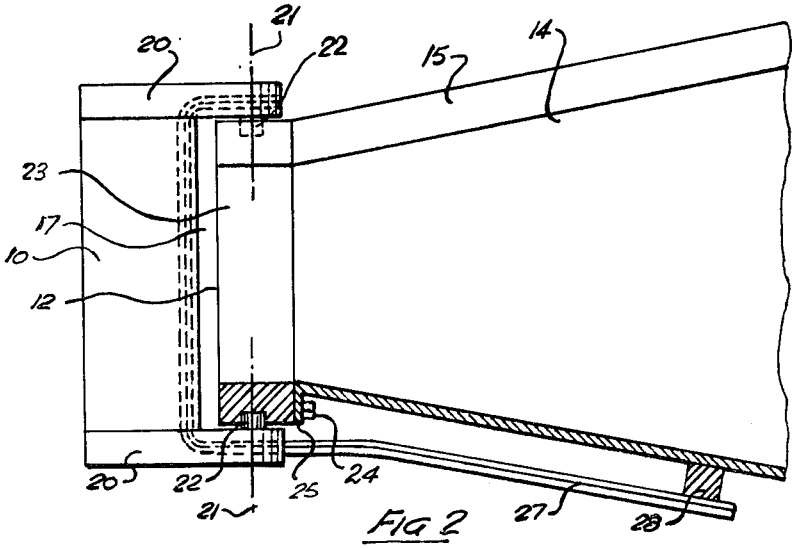
FIG. 2 is a plan view of the splitter assembly shown in FIG. 1 including a part-section on line A—A thereof.
Figure 3:
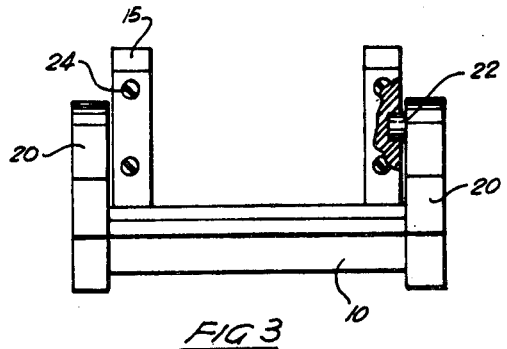
FIG. 3 is a partly sectioned end elevation of the splitter assembly shown in the previous two figures.
Figure 4:
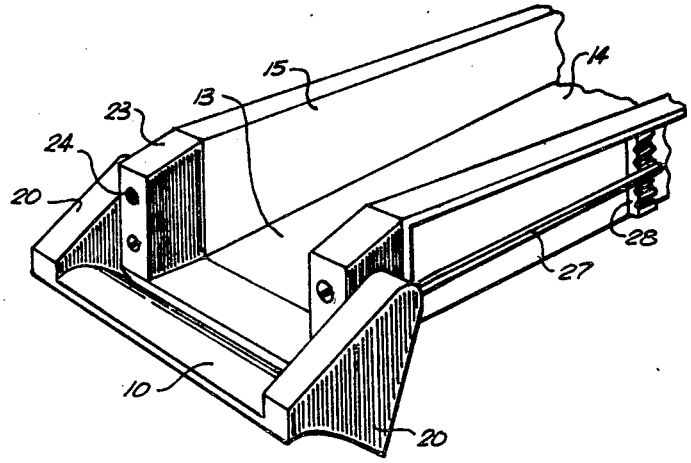
FIG. 4 is a perspective view of the splitter assembly illustrated in the previous figures.

Referring to the drawings, the splitter 10 presents a curved splitting surface 11 to the discharge edge 12 of the stratification surface 13. The stratification surface 13 forms the floor of an inclined tray concentrator 14 having converging side walls 15.

Figure 5:
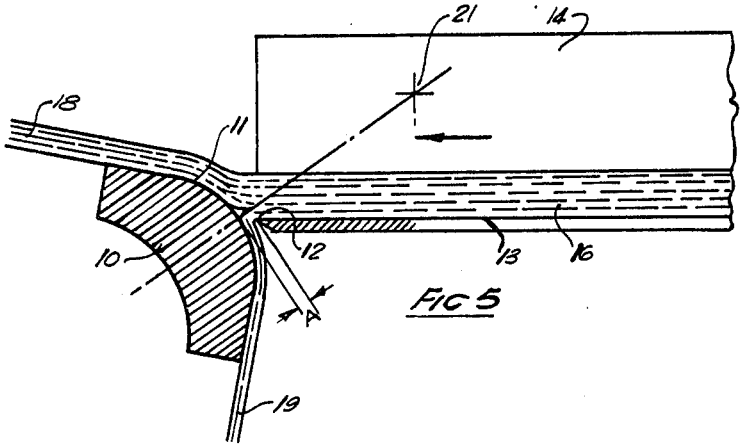
FIGS. 5, 6 and 7 are diagrammatic sectional side elevations of the splitter assembly shown in the previous Figures but illustrate different settings of the splitter relative to the stratifications surface for progressively increasing lower flow components.
Figure 6:
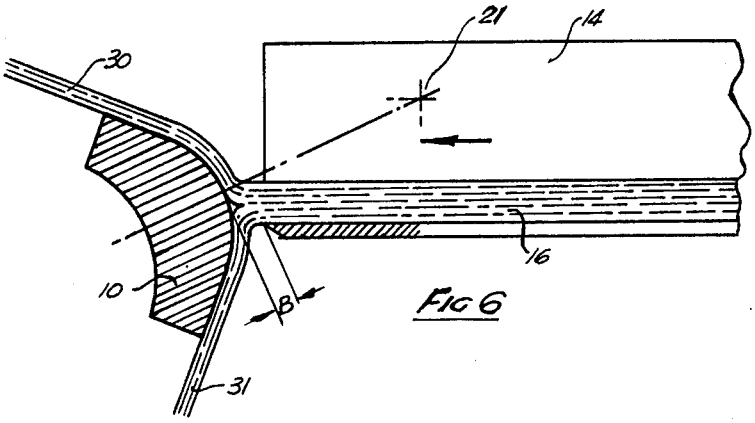
Figure 7:
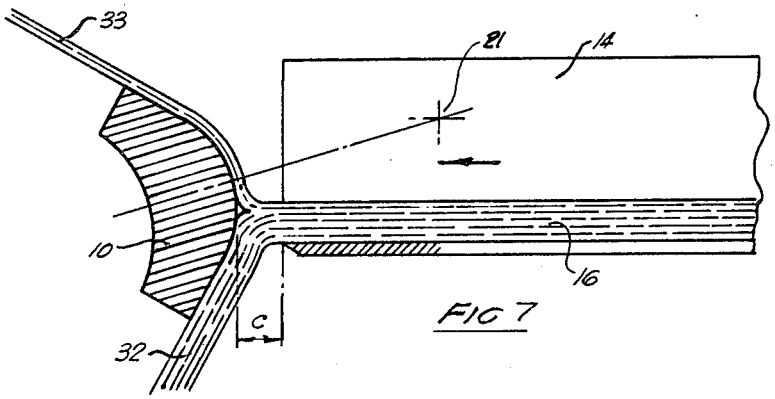

A stratified pulp stream 16 flowing downwardly over the stratification surface 13 as shown in FIGS. 5, 6 and 7, flows over the discharge edge 12 and across the gap 17 to impinge upon the curved splitting surface and separate into upper and lower component streams 18 and 19 respectively.

In accordance with the invention, the splitter 10 is adjustable relative to the stratification surface and this adjustability is achieved by rigidly attaching the splitter 10 to two radial arms 20 which hinge about an axis of rotation 21 located above the stratification surface 13 and displaced upstream from the discharge edge 12. The axis 21 is defined by a pair of axially aligned pins 22, each being connected to one of the radial arms 20 and pivotally mounted to a U-shaped connecting block 23 secured by fastening means 24 to transversely extending flanges 25 on the side walls 15. By this means, the entire splitter assembly can be removed from the tray for maintenance or replacement.

The angular position of the splitter 10 with respect to the stratification surface 13 may be selectively varied by the lever 27 which is rigidly connected to the splitter and may be engaged in any one of a number of selected positions on rack 28.

The method of operation of the invention is best shown in FIGS. 5 to 7 which illustrate the relationship of the stratification surface 13, discharge edge 12, splitter surface 11, and the component streams at three settings of the illustrated splitter assembly. It will be appreciated that for any given assembly, the optimum vertical displacement of the axis of rotation above the stratification surface and the horizontal displacement upstream from the discharge edge depend on the shape of the splitter surface chosen for the required application. The relative proportions illustrated are, therefore, of a typical embodiment only.

In FIG. 5, the splitter 10 is towards the lower extreme of its rotational travel and therefore the angle of incidence of the stream on the curved splitter surface 11 is such that the lower stream component 19 discharged through the gap is relatively small. The gap width "A" is sufficient to permit free discharge of the lower component stream 19 but is not excessively large with the result that errors arising from variations in stream trajectory after discharge from the stratification surface are minimised.

In FIG. 6, the splitter is illustrated at approximately a position of mid-travel with the upper and lower component streams 30 and 31 respectively being approximately equal. The gap width "B" is greater than the equivalent dimension "A" in FIG. 5 and therefore provides the greater area required for the increased volume of the lower component stream 31.

In FIG. 7, the splitter is illustrated towards the upper extreme of its travel with a consequent further increase in the volume of the lower component stream 32. The gap width "C" has increased still further in order to provide the area required for the increased flow of the lower component stream 32 which now exceeds that of its associated upper component stream 33.

It will be appreciated that the required increase in the width and therefore the area of the gap with an increase in the lower component stream is achieved very simply. Furthermore, the illustrated splitter system employs only one moving part rotating around a fixed axis of rotation. This arrangement permits the consistent achievement of high mechanical accuracies under arduous conditions. The position of the axis of rotation is also remote from the pulp stream with the result that the contact surfaces have considerable inherent protection from contamination by abrasive solid particles from the pulp stream.

Although the invention has been described with reference to a specific example, it will be appreciated by those skilled in the art that the invention may be embodied in many other forms without departing from the scope of the inventive concept.

I claim:

1. A splitter assembly of the type wherein a pulp stream is discharged from the discharge edge of a stratification surface across a gap to impinge against a splitter so as to separate into upper and lower flow components, the lower component passing through said gap while the upper component flows over said splitter, the splitter having a generally curved impingement surface and mounted to be adjustable relative to the stratification surface such that the gap width in the direction of stream flow increases as the required lower flow component increases and decreases as the required lower flow component decreases, the splitter assembly being hingedly mounted for rotation about an axis located above said stratification surface and displaced upstream from said discharge edge.

2. A splitter assembly as claimed in claim 1, in which said impingement surface is curved when viewed in a vertical plane parallel with the direction of impinging flow.

3. A splitter assembly as claimed in claim 1 wherein said assembly is provided with means for securing said splitter in any one of a number of predetermined positions angularly spaced about said axis.

4. A splitter assembly as claimed in claim 3 wherein said securing means includes a lever fixed relative to said splitter for conjoined rotation therewith and able to engage with any one of a plurality of slots formed in a rack fixed relative to said stratification surface.

5. A method of adjusting a splitter for a pulp stream in a splitter assembly having a splitter spaced downstream from a gap and hingedly mounted for rotation about an axis located above the stratification surface of the pulp and displaced upstream from said discharge gap including the steps of increasing the gap width by rotating the splitter about said axis to produce an increased lower flow component or decreasing the gap width when the splitter is adjusted to produce a reduced lower flow component.

6. A method as claimed in claim 5 wherein said splitter has a generally curved splitting surface against which the discharged pulp stream impinges.

7. A method as claimed in claim 6 wherein said assembly is provided with means for securing said splitter in any one of a number of predetermined positions angularly spaced about said axis.

8. A method as claimed in claim 7 wherein said securing means includes a lever fixed relative to said splitter for conjoined rotation therewith and able to engage with any one of a plurality of slots formed in a rack fixed relative to said stratification surface.

* * * * *